US006756022B2

(12) United States Patent
Sakai et al.

(10) Patent No.: US 6,756,022 B2
(45) Date of Patent: Jun. 29, 2004

(54) APPARATUS FOR REMOVING SULFUR-CONTAINING COMPONENT IN FUEL

(75) Inventors: Takenobu Sakai, Nishikamo-gun (JP); Tatsuji Mizuno, Yokohama (JP); Hiroshi Suzuki, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 484 days.

(21) Appl. No.: 09/940,591

(22) Filed: Aug. 29, 2001

(65) Prior Publication Data

US 2002/0028505 A1 Mar. 7, 2002

(30) Foreign Application Priority Data

Sep. 1, 2000 (JP) ..... 2000-265667
Aug. 10, 2001 (JP) ..... 2001-244650

(51) Int. Cl.[7] ..... C10G 19/00; C10G 32/00
(52) U.S. Cl. ..... 422/189; 208/226; 208/299; 435/282
(58) Field of Search ..... 422/188–190, 422/211; 208/208 R, 226, 299, 307; 435/282

(56) References Cited

U.S. PATENT DOCUMENTS 2,975,103 A * 3/1961 Kirshenbaum ..... 435/282
2,988,500 A * 6/1961 Gleim et al. ..... 208/206
3,108,081 A * 10/1963 Gleim et al. ..... 502/163
4,343,693 A * 8/1982 Holland et al. ..... 208/244
5,104,801 A * 4/1992 Kilbane, II ..... 435/282
5,496,729 A * 3/1996 Monticello ..... 435/282
5,843,300 A * 12/1998 Zinnen et al. ..... 208/250
5,874,294 A * 2/1999 Valentine ..... 435/282
6,071,738 A * 6/2000 Johnson et al. ..... 435/282
6,124,130 A * 9/2000 Olson ..... 435/282
6,129,835 A * 10/2000 Lesieur et al. ..... 208/208 R
6,204,046 B1 * 3/2001 Chang et al. ..... 435/252.1
6,337,204 B1 * 1/2002 Monot et al. ..... 435/282
6,429,170 B1 * 8/2002 Dodwell ..... 502/400
6,454,935 B1 * 9/2002 Lesieur et al. ..... 208/244

FOREIGN PATENT DOCUMENTS

JP A 2-235992 9/1990
JP A 10-117799 5/1998
JP A 11-9293 1/1999

OTHER PUBLICATIONS

Takeshi Ashida, "Lubricity Improver for Engine Fuel", Toyota Technical Review, Jan. 1999, p. 299.

* cited by examiner

*Primary Examiner*—Kiley Stoner
*Assistant Examiner*—Kevin McHenry
(74) *Attorney, Agent, or Firm*—Oliff & Berridge, PLC

(57) ABSTRACT

There is provided a desulphurization apparatus to be mounted in automobiles, which is arranged between a fuel tank and an injector of an engine, the apparatus comprising a combination of a sulfur-containing compound adsorbent for adsorbing and concentrating the sulfur-containing compound and a sulfur-containing compound oxidizing agent or oxidation catalyst for oxidizing the adsorbed sulfur-containing compound, the apparatus further comprising a means for recovering and removing the resulting sulfur-containing oxide. According to this apparatus, the quantity of the particulate matter in an exhaust gas is reduced by half and the durability of the catalyst for removing a nitrogen oxide is improved by a factor of about two.

12 Claims, No Drawings

APPARATUS FOR REMOVING SULFUR-CONTAINING COMPONENT IN FUEL

BACKGROUND OF INVENTION

1. Field of Invention

The present invention relates to an apparatus for removing a sulfur-containing compound contained in a fuel for automobiles between a fuel tank and an injector of an engine or in a gas station fuel tank or a tanker truck, and which is particularly suited for use as an apparatus to be mounted in automobiles.

2. Related Art

A sulfur-containing compound contained in a fossil fuel is a direct contributor of sulfur oxide in exhaust gas after combustion, and is also a contributor to generating particulate matter in the exhaust gas. Furthermore, removal of the sulfur-containing compound before combustion is important to maintain the service life of a catalyst type for removing nitrogen oxide in the exhaust gas.

It has hitherto been considered to be particularly difficult to remove an aromatic sulfur-containing compound such as benzothiophene, dibenzothiophene or the like among sulfur-containing compounds contained in the fossil fuel.

Japanese Unexamined Patent Publication (Kokai) No. 2-235992 describes a method of passing a fuel into a first cellulose filter packed with a chromate compound, as a means for removing impurities such as an aromatic substance in the fuel, and passing the fuel through a second filter filled with water, thereby to remove impurities. However, there is no specific description about removal of a sulfur-containing aromatic compound.

Japanese Unexamined Patent Publication (Kokai) No. 11-9293 describes bacteria capable of decomposing alkylated benzothiophene or alkylated dibenzothiophene. However, there is no specific description about the use of bacteria for removal of a sulfur-containing aromatic compound in a fuel.

Japanese Unexamined Patent Publication (Kokai) No. 10-117799 describes a method of decomposing dibenzothiophene using microorganisms such as *Coriolus versicolor*. However, there is no description about a specific method of removing dibenzobenzene in a fuel.

SUMMARY OF INVENTION

It is therefore an object of the present invention to provide an apparatus for efficiently removing a sulfur-containing compound contained in a fossil fuel for automobiles in a comparatively trace amount, especially an aromatic sulfur-containing compound such as benzothiophene, dibenzothiophene or the like before combustion.

As a result of substantial research to solve the problems as described above, the present inventors have found that a sulfur-containing aromatic compound, which could not be removed easily by the method of the prior art, can be efficiently removed by adsorbing a sulfur-containing compound in a fuel, thereby to concentrate the sulfur-containing compound, and chemically oxidizing the concentrated sulfur-containing compound using an oxidizing agent or an oxidation catalyst. Thus, the present invention has been accomplished.

More specifically, the present invention provides a sulfur-containing compound removing apparatus, which is arranged between a fuel tank and an injector of an engine or arranged in a gas station fuel tank or a tanker truck, the apparatus comprising:

(1) a sulfur-containing compound adsorbent for adsorbing the sulfur-containing compound in a fuel;

(2) a sulfur-containing compound oxidizing agent or oxidation catalyst for oxidizing the sulfur-containing compound to form a sulfur-containing oxide, which is immobilized in the sulfur-containing compound adsorbent (1) or coexists with the sulfur-containing compound; and (3) (3-a) a sulfur-containing adsorbent for adsorbing the sulfur-containing oxide, which coexists with the sulfur-containing compound adsorbent (1) and the sulfur-containing compound oxidation catalyst (2) or arranged at a lower stream thereof; and/or (3-b) a sulfur-containing oxide salt removing means for removing the sulfur-containing oxide as a salt thereof.

The present invention also provides a sulfur-containing compound removing apparatus, which is arranged between a fuel tank and an injector of an engine or arranged in a tank of a gas station or a tank lorry, the apparatus comprising:

(1) a sulfur-containing compound adsorbent for adsorbing the sulfur-containing compound in a fuel;

(2) a sulfur-containing compound oxidizing agent or oxidation catalyst for oxidizing the sulfur-containing compound to form a sulfur-containing oxide, which is immobilized in the sulfur-containing compound adsorbent (1) or coexists with the sulfur-containing compound;

(3) a microorganism-immobilized carrier in which a microorganism capable of oxidizing the sulfur-containing oxide into a sulfate salt or a sulfite salt has been immobilized, which coexists with the sulfur-containing compound adsorbent (1) and the sulfur-containing compound oxidation catalyst (2) or arranged at a lower stream thereof; and (4) (4-a) a sulfur-containing adsorbent for adsorbing the sulfur-containing oxide, which coexists with the microorganism-immobilized carrier (3) or arranged at a lower stream thereof; and/or (4-b) a sulfur-containing oxide salt removing means for removing the sulfur-containing oxide, the sulfate salt or the sulfite salt in the form of an insoluble salt thereof.

The sulfur-containing oxide salt removing means (3-b) or (4-b) is, for example, a filter or porous material which supports an oxide or a salt of an alkali metal or an alkali earth metal.

The sulfur-containing oxide salt removing means (3-b) or (4-b) is, for example, an insoluble sulfate salt filtering-off filter.

DETAILED DESCRIPTION

The compound to be removed by the apparatus of the present invention is a sulfur-containing compound contained in a fossil fuel, especially an aromatic sulfur-containing compound, and more especially benzothiophene, dibenzothiophene and a substituted derivative thereof, especially a substituted derivative having a methyl group.

The apparatus of the present invention is an apparatus for removing a sulfur-containing compound in a fuel before combustion in an engine, which is arranged between a fuel tank and an injector of an engine or arranged in a gas station fuel tank or a tanker truck. The apparatus is particularly suited for use as an apparatus mounted in automobiles. The apparatus arranged in the tank of a gas station or a tanker truck is preferably brought into contact with a fuel by immersion in the fuel in the tank. In this case, movement of the fuel itself may be utilized or the fuel may be forcibly circulated.

According to the apparatus of the present invention, a sulfur-containing compound in a fuel is adsorbed by a sulfur-containing compound adsorbent, thereby to concentrate the sulfur-containing compound into the adsorbent before combustion, and then the concentrated sulfur-containing compound is oxidized by using a chemical oxidizing agent (sulfur-containing compound oxidizing agent) or an oxidation catalyst (sulfur-containing compound oxidation catalyst). Accordingly, the adsorbed and concentrated sulfur-containing compound must be brought into contact with the sulfur-containing compound oxidizing agent or oxidation catalyst. To ensure this contact, according to one embodiment of the present invention, the sulfur-containing compound oxidizing agent or oxidation catalyst is supported/immobilized in the sulfur-containing compound adsorbent. According to another embodiment, the sulfur-containing compound adsorbent and the sulfur-containing compound oxidizing agent or oxidation catalyst may merely coexist, for example, the two may be mixed.

The sulfur-containing compound adsorbent may be any one which can adsorb a sulfur-containing compound, especially an aromatic sulfur-containing compound, and more specifically benzothiophene or dibenzothiophene or a derivative thereof. Examples thereof include mesoporous silica porous material (FSM), zeolite, acid clay, active clay and the like. The sulfur-containing compound oxidizing agent may be any one which can oxidize an aromatic sulfur-containing compound, and examples thereof include an oxidizing agent made of an oxidized metal, for example, titanium oxide ($TiO_2$), nickel oxide (NiO), manganese dioxide ($MnO_2$), potassium permanganate ($KMnO_4$), manganese sulfate ($MnSO_4$)+ascorbic acid, vanadium oxide ($V_2O_3$), molybdenum oxide ($MoO_3$) and the like. Examples of the oxidation catalyst include catalysts made of metals such as platinum, nickel and the like.

By passing a fuel to be treated in the co-presence of the above-described sulfur-containing compound adsorbent and the sulfur-containing compound oxidizing agent or oxidation catalyst, the sulfur-containing compound in the fuel is adsorbed by the sulfur-containing compound adsorbent and removed from the fuel. Then, the sulfur-containing compound, which was adsorbed by the sulfur-containing compound adsorbent and thus concentrated, is oxidized into dibenzothiophene sulfoxide (>S═O compound) or dibenzothiophene sulfone (>S(═O)$_2$ compound) by oxygen fed from the sulfur-containing oxidizing agent or a catalytic action of the sulfur-containing compound oxidation catalyst. Oxygen for oxidizing from the oxidizing catalyst is provided by oxygen contained in the fuel.

When the sulfur-containing compound adsorbed by the sulfur-containing compound adsorbent is oxidized and changed into a sulfur-containing oxide, the sulfur-containing oxide is desorbed from the sulfur-containing compound adsorbent and then discharged into the fuel. Accordingly, the sulfur-containing compound in the fuel must be recovered and removed. The method of recovering and removing the sulfur-containing compound includes, for example, a method of removing by desorbing and immobilizing the sulfur-containing compound in the fuel and a method of removing by reacting the sulfur-containing compound with a base to form an insoluble salt.

According to the first embodiment of the present invention, the sulfur-containing compound removing apparatus includes a sulfur-containing oxide absorbent. This sulfur-containing oxide adsorbent may coexist with the sulfur-containing compound adsorbent and the sulfur-containing compound oxidizing agent or oxidation catalyst. Alternatively, the sulfur-containing oxide adsorbent may be arranged at a lower stream of the sulfur-containing compound adsorbent and the sulfur-containing compound oxidizing agent or oxidation catalyst with respect to a flow direction of the fuel.

The sulfur-containing oxide adsorbent is not specifically limited, as long as it can adsorb and remove the sulfur-containing oxide polarized in the fuel, and examples thereof include active clay, zeolite and the like. In the case of the material having strong asorptivity to the polarized sulfur-containing oxide, like the sulfur-containing oxide adsorbent such as active clay, zeolite and the like, the material can be used in place of the both of the sulfur-containing compound adsorbent and the sulfur-containing oxide adsorbent.

According to the second embodiment of the present invention, the sulfur-containing compound removing apparatus of the present invention includes an oxide salt removing means for removing the sulfur-containing oxide discharged into the fuel in the form of its insoluble salt. This apparatus is particularly useful in the case where the sulfur-containing oxide is isolated in the form of an inorganic sulfate salt or a sulfate salt. Examples of the oxide salt removing means include oxide salt removing means composed of a filter or porous material which supports an oxide or a salt of an alkali metal or an alkali earth metal.

The metal oxide or salt may be any one which reacts with a sulfuric acid ion ($SO_4^{--}$) or a sulfurous acid ion ($SO_3^{--}$) to form an insoluble salt and, for example, there can be used a calcium salt such as calcium oxide or calcium chloride (insoluble calcium sulfate or calcium sulfite is formed) and a barium salt such as barium oxide or barium chloride (insoluble barium sulfate or barium sulfite is formed).

When a metal salt such as calcium salt or barium salt, for example, calcium chloride or barium chloride, is previously added to the fuel and a sulfur-containing oxide, especially a sulfate salt or sulfite salt is formed by oxidation of the sulfur-containing compound, the sulfate or sulfite salt can be removed by filtration after changing into barium sulfate or barium sulfite. In this case, the sulfur-containing oxide salt removing means is a filter capable of removing the insoluble salt described above.

According to the embodiment described above of the present invention, by removing the aromatic sulfur-containing compound before combustion, not only can the quantity of sulfur oxide in the fuel discharged from the engine be reduced, but the quantity of the particulate matter can also be reduced by approximately 50% and the durability of the catalyst for removing a nitrogen oxide can be improved by a factor of about two.

According to another embodiment of the present invention, the sulfur-containing compound produced by the sulfur-containing compound oxidizing agent or oxidation catalyst is oxidized into a sulfate salt or a sulfite salt by the action of microorganisms, and then the sulfate or sulfite salt is removed in the form of an insoluble salt. Accordingly, according to the present invention, the sulfur-containing compound removing apparatus of the present invention includes a microorganism-immobilized carrier in which a microorganism capable of oxidizing the sulfur-containing oxide into a sulfate salt or a sulfite salt has been immobilized.

Various microorganisms capable of oxidizing a typical aromatic sulfur-containing compound such as dibenzothiophene into a sulfate salt are known, and examples thereof include *Rhodococcus rhodochrous* ATCC53968. It is considered that this microorganism oxidizes dibenzothiophene into 2-hydroxybiphenyl and a sulfate salt via dibenzothiophene sulfoxide (>S═O compound), dibenzothiophene sulfone (>S(═O)$_2$ compound) and 2-hydroxybiphenyl-2-sulfinic acid (—SO(OH) compound).

Because of the number of processes involved in oxidizing dibenzothiophene into the sulfate salt and the low oxidizing rate, the conventional microbial method is not suited for practical use as a unit of a desulphurization apparatus arranged between a fuel tank and an injector of an engine. However, according to the present invention, oxidation of dibenzothiophene into dibenzothiophene sulfone ($>S(=O)_2$ compound) is conducted by the sulfur-containing compound oxidizing agent or oxidation catalyst and only the following oxidation into a sulfate salt is conducted by microorganisms, a sufficiently high oxidizing rate can be achieved. Therefore, the present method is suited for practical use as a unit of a desulphurization apparatus arranged between a fuel tank and an injector of an engine.

AS the microorganism able to oxidize monobenzothiophene or dibenzothiophene into a sulfate salt, for example, various microorganism are known, including *Rhodococcus rhodochrous* ATCC53968, and are easily available commercially. Accordingly, commercially available arbitrary microorganisms can be used as the microorganism used in the desulphurization apparatus of the present invention.

As the carrier for immobilization of a microorganism, for example, there can be used any carrier used generally to immobilize the microorganism. A mesoporous silica porous body having an OH group on the surface thereof such as FMS or zeolite and clay minerals such as kaolin, montmorillonite and benzonite are particularly preferred. Consequently, it becomes easy to separate moisture contained in the fuel from the fuel, thereby making the system simple. To immobilize a microorganism strain in an immobilizing carrier, a conventional immobilizing means such as cellulose, polyvinyl alcohol, resin polymer or the like can be used.

By passing the fuel containing the sulfur-containing oxide through the carrier in which a microorganism has been immobilized, at least a portion of the sulfur-containing oxide contained in the fuel is oxidized into a sulfate salt, i.e. not all of the sulfur-containing oxide contained in the fuel is always oxidized into the sulfate salt. Accordingly, the fuel passed through the carrier in which a microorganism has been immobilized generally contains both the sulfur-containing oxide and sulfate salt produced by oxidation due to the sulfur-containing compound oxidizing agent or oxidation catalyst. To remove them, the sulfur-containing oxide adsorbent and sulfur-containing oxide salt removing means, which were previously described in detail, are preferably used in combination.

According to the embodiment using the microorganism of the present invention, by removing the aromatic sulfur-containing compound before combustion, not only can the quantity of the sulfur oxide in the fuel discharged from the engine be reduced, but the quantity of the particulate matter can also be reduced by approximately 50% and the durability of the catalyst for removing a nitrogen oxide can be improved by a factor of about two.

According to the desulphurization apparatus of the present invention, by removing an aromatic sulfur-containing compound before combustion, not only can the quantity of a sulfur oxide in an exhaust gas discharged from an engine be reduced, but the quantity of particulate matter in the exhaust gas can also be reduced and the durability of a catalyst for removing nitrogen oxide can be improved.

What is claimed is:

1. A sulfur-containing compound removing apparatus, which is in communication with fuel in a fuel tank the apparatus comprising:

(1) a sulfur-containing compound adsorbent for adsorbing the sulfur-containing compound in a fuel;

(2) a sulfur-containing compound oxidizing agent or oxidation catalyst for oxidizing the sulfur-containing compound to form a sulfur-containing oxide, which is immobilized in the sulfur-containing compound adsorbent (1) or coexists with the sulfur-containing compound; and (3) (3-a) a sulfur-containing adsorbent for adsorbing the sulfur-containing oxide, which coexists with the sulfur-containing compound adsorbent (1) and the sulfur-containing compound oxidation catalyst (2) or is arranged at a lower stream thereof; and/or (3-b) a sulfur-containing oxide salt removing means for removing the sulfur-containing oxide in the form of a salt thereof.

2. The apparatus according to claim 1, wherein the sulfur-containing oxide salt removing means (3-b) is a filter or porous material which supports an oxide or a salt of an alkali metal or an alkali earth metal.

3. The apparatus according to claim 2, wherein the sulfur-containing oxide salt removing means (3-b) is an insoluble sulfate filter.

4. The apparatus according to claim 1, wherein said apparatus is between the fuel tank and an injector of an engine.

5. The apparatus according to claim 1, wherein the fuel tank is a gas station fuel tank.

6. The apparatus according to claim 1, wherein the fuel tank is in a tanker truck.

7. An sulfur-containing compound removing apparatus, which is in communication with fuel in a fuel tank the apparatus comprising:

(1) a sulfur-containing compound adsorbent for adsorbing the sulfur-containing compound in a fuel;

(2) a sulfur-containing compound oxidizing agent or oxidation catalyst for oxidizing the sulfur-containing compound to form a sulfur-containing oxide, which is immobilized in the sulfur-containing compound adsorbent (1) or coexists with the sulfur-containing compound;

(3) a microorganism-immobilized carrier in which a microorganism capable of oxidizing the sulfur-containing oxide into a sulfate salt or a sulfite salt has been immobilized, which coexists with the sulfur-containing compound adsorbent (1) and the sulfur-containing compound oxidation catalyst (2) or is arranged at a lower stream thereof; and (4) (4-a) a sulfur-containing adsorbent for adsorbing the sulfur-containing oxide, which coexists with the microorganism-immobilized carrier (3) or is arranged at a lower stream thereof; and/or (4-b) a sulfur-containing oxide salt removing means for removing the sulfur-containing oxide, the sulfate salt or the sulfite salt in the form of an insoluble salt thereof.

8. The apparatus according to claim 7, wherein the sulfur-containing oxide salt removing means (4-b) is a filter or porous material which supports an oxide or a salt of an alkali metal or an alkali earth metal.

9. The apparatus according to claim 7, wherein the sulfur-containing oxide salt removing means (4-b) is an insoluble sulfate filter.

10. The apparatus according to claim 7, wherein said apparatus is between the fuel tank and an injector of an engine.

11. The apparatus according to claim 7, wherein the fuel tank is a gas station fuel tank.

12. The apparatus according to claim 7, wherein the fuel tank is in a tanker truck.

* * * * *